US007159439B2

(12) United States Patent
Gascoin et al.

(10) Patent No.: US 7,159,439 B2
(45) Date of Patent: Jan. 9, 2007

(54) AUTOMATIC CONTROL OF INTERMEDIATE PIECES IN A BENDING PRESS

(75) Inventors: Eric Gascoin, Luynes (FR); Jean-Louis Fourmy, Mayet (FR)

(73) Assignee: Amada Europe (FR)

( * ) Notice: Subject to any disclaimer, the term of this patent is extended or adjusted under 35 U.S.C. 154(b) by 346 days.

(21) Appl. No.: 10/823,336

(22) Filed: Apr. 12, 2004

(65) Prior Publication Data

US 2004/0211237 A1 Oct. 28, 2004

(30) Foreign Application Priority Data

Apr. 25, 2003 (FR) ..... 03 05099

(51) Int. Cl.
*B21D 5/02* (2006.01)
*B21D 37/04* (2006.01)

(52) U.S. Cl. ..... 72/482.2; 72/482.3; 72/481.1; 72/481.6

(58) Field of Classification Search ..... 72/389.3, 72/481.1, 481.3, 481.6, 482.1, 482.2, 482.3, 72/482.6

See application file for complete search history.

(56) References Cited

U.S. PATENT DOCUMENTS 6,003,360 A * 12/1999 Runk et al. ..... 72/482.2
6,450,004 B1 * 9/2002 Edmondson et al. ..... 72/482.3
6,557,390 B1 * 5/2003 Runk et al. ..... 72/482.1
6,564,611 B1 * 5/2003 Harrington et al. ..... 72/481.2
6,606,896 B1 * 8/2003 Tarasconi ..... 72/482.3

FOREIGN PATENT DOCUMENTS

FR 0305099 11/2003
JP 06142767 5/1994
JP 09295053 11/1997

* cited by examiner

*Primary Examiner*—David Jones
(74) *Attorney, Agent, or Firm*—Lucas & Mercanti, LLP

(57) ABSTRACT

The invention relates to a bending press comprising a bottom panel, a moving top panel, N bending-tool clamps, each clamp being mounted to pivot about a common axis, and means for causing the clamps to pivot. The means for causing the clamps to pivot comprise:

a plurality of actuators each suitable for taking up two states;

a plurality of transmission means for transmitting the state of each actuator assembly to a plurality of adjacent clamps, in such a manner each clamp is associated with a single actuator; and means for separately controlling the state of each actuator between a first state which brings the clamps associated with the actuator into a position for clamping the bending tool, and a second state which brings the clamps associated with the actuator into a position for removing said bending tools.

12 Claims, 4 Drawing Sheets

AUTOMATIC CONTROL OF INTERMEDIATE PIECES IN A BENDING PRESS

The present invention relates to a bending press, and more particularly to the system for clamping bending tools to the top panel of a bending press.

BACKGROUND OF THE INVENTION

With reference initially to FIGS. 1, 2A, and 2B, there follows a description of the essential members of a prior art type of bending press.

As can be seen in FIG. 1, the bending press comprises a stationary bottom panel 12, a vertical frame 14, and a moving top panel 16 capable of moving vertically relative to the stationary bottom panel 12. The top panel 16 is moved by means of two control actuators 18 and 20.

The stationary bottom panel 12 has bending dies such as 22 fixed thereon, the right section of a die perpendicular to the plane of the figure being V-shaped. The moving top panel 16 serves to carry bending tools or punches 24. Each punch 24 is fixed to the top panel 16 by being clamped between a stationary or intermediate piece 26 which is releasably fixed to the top panel 16, and a pivoting clamp 28 mounted on the intermediate piece 26. Each clamp 28 can pivot relative to the associated intermediate piece 26 about an axis XX' common to all of the intermediate pieces and parallel to the long direction of the bending press.

With reference to FIGS. 2A and 2B, there follows a more detailed description of how the punches 24 are fixed. Each clamp 28 comprises a middle portion 28*a* which receives a pivot axis extending parallel to the long direction of the top panel and which is constituted in this particular example by hemispherically-headed screws 30 engaged in the intermediate piece 26. Each clamp 28 also has a control top end 28*b* and a clamping bottom end 28*c*. The tang 32 of the punch 24 has two clamping faces 32*a* and 32*b* for pressing respectively against the clamping surface 34 of the intermediate piece 26 and the clamping surface 35 at the bottom end 28*c* of the clamp 28. Pivoting of the clamp about the axis defined by the heads of the screws 30 is controlled by pushers 36 each having one end 36*a* co-operating with the end 38*b* of the clamp and having a second end 36*b* co-operating with a pivot-controlling cam 38. It will be understood that by acting on the control cam 38, the pushers 36 are caused to move so as to cause the end 28*c* of the clamp 28 to go from the clamping position shown in FIG. 2A to the release position shown in FIG. 2B. In this second position, the tool 24 can be removed from the top panel 16.

Mechanical systems other than the pivoting cam 38 could be used for controlling pivoting of the clamp 28. In general, two major types of clamp control can be provided, either control associated with each clamp mounted on an intermediate piece, or else overall control for all of the clamps on the intermediate pieces mounted on the entire top panel 16.

When the bending operations to be performed with the press need to be modified, it is necessary to begin by replacing the tools or punches that were previously mounted on the top panel with new punches. As a general rule, these changes apply to only a fraction of the tools, and thus to only a fraction of the intermediate pieces and clamps 28 of the top panel. In addition, it will be understood that these tool-changing operations and the adjustments that need to be performed after changing a tool constitute periods during which the bending press is not in use. It is therefore very useful to have bending presses in which these stages, in particular tool-changing stages, can be implemented using a minimum number of operations leading to the machine being out of action for a minimum length of time.

OBJECTS AND SUMMARY OF THE INVENTION

An object of the present invention is to provide a bending press fitted with an assembly for fixing tools to the top panel that enables the operations of removing and replacing tools on the moving top panel of the press to be optimized.

According to the invention, this object is achieved by a bending press comprising:

a bottom panel;

a top panel;

one of the panels being movable vertically relative to the other;

N bending-tool clamps, each clamp being mounted to pivot about a common axis; and means for causing said clamps to pivot about said axis;

wherein said means for causing the clamps to pivot comprise:

a plurality of actuator assemblies each suitable for taking up two states;

a plurality of transmission means for transmitting the state of each actuator assembly to a plurality of adjacent clamps of number smaller than N, in such a manner that each clamp is associated with a single actuator assembly; and means for separately controlling the state of each actuator assembly between a first state which brings the clamps associated with the actuator assembly into a position for clamping a bending tool, and a second state which brings the clamps associated with the actuator assembly into a position for removing said bending tools.

It will be understood that because a plurality of adjacent clamps are pivoted under the control of the same actuator assembly, it is possible to reduce considerably the time needed for changing tools by suitably associating the clamps controlled by a given actuator assembly. In addition, depending on requirements, it is possible to change the clamps that are controlled by a given actuator assembly.

It should also be emphasized that the invention can be applied to circumstances in which the top panel is the moving panel or in which the bottom panel is the moving panel, with the top panel then being stationary.

In addition, and preferably, the clamps serve to fix the bending punches to the top panel regardless of whether it is a stationary panel or a moving panel. Nevertheless, the clamps with their control system could equally well serve for fixing the bending V-shapes which are fixed to the bottom panel. Under such circumstances, the term "bending tool" should be understood as covering not only the punches, but also the bending V-shape.

Preferably, in the bending press, said bottom panel is stationary and said top panel is vertically movable, the press further comprises N intermediate pieces rigidly fixed to said top panel, each clamp is mounted facing an intermediate piece, and the means for causing the clamps to pivot further comprise:

N clamp pivot mechanisms, each mechanism being associated with one clamp and one intermediate piece, each mechanism presenting a control portion;

a plurality of link means for interconnecting the control portions of n mechanisms associated with n adjacent clamps, where n is an integer lying in the range $1 \leqq n < N$; and a plurality of transmission means for mechanically connecting each actuator assembly to a link means.

In a preferred embodiment of the invention for fixing punches, each clamp pivoting mechanism comprises two pivot assemblies mounted respectively at the two ends of the intermediate piece associated with the clamp, each pivot assembly comprising a first lever forming said control portion.

Also preferably, for fixing punches, said link means comprise 2n second levers, each second lever being hinged at a first end to the end of a first lever, and means for interconnecting the second ends of the second levers.

Also preferably, each actuator means comprises at least one actuator whose cylinder is secured to the top panel and having a rod whose end is connected to a link means.

BRIEF DESCRIPTION OF THE DRAWINGS

Other characteristics and advantages of the invention appear better on reading the following description of various embodiments of the invention given as non-limiting examples. The description refers to the accompanying drawings, in which.

MORE DETAILED DESCRIPTION

Figure 1:
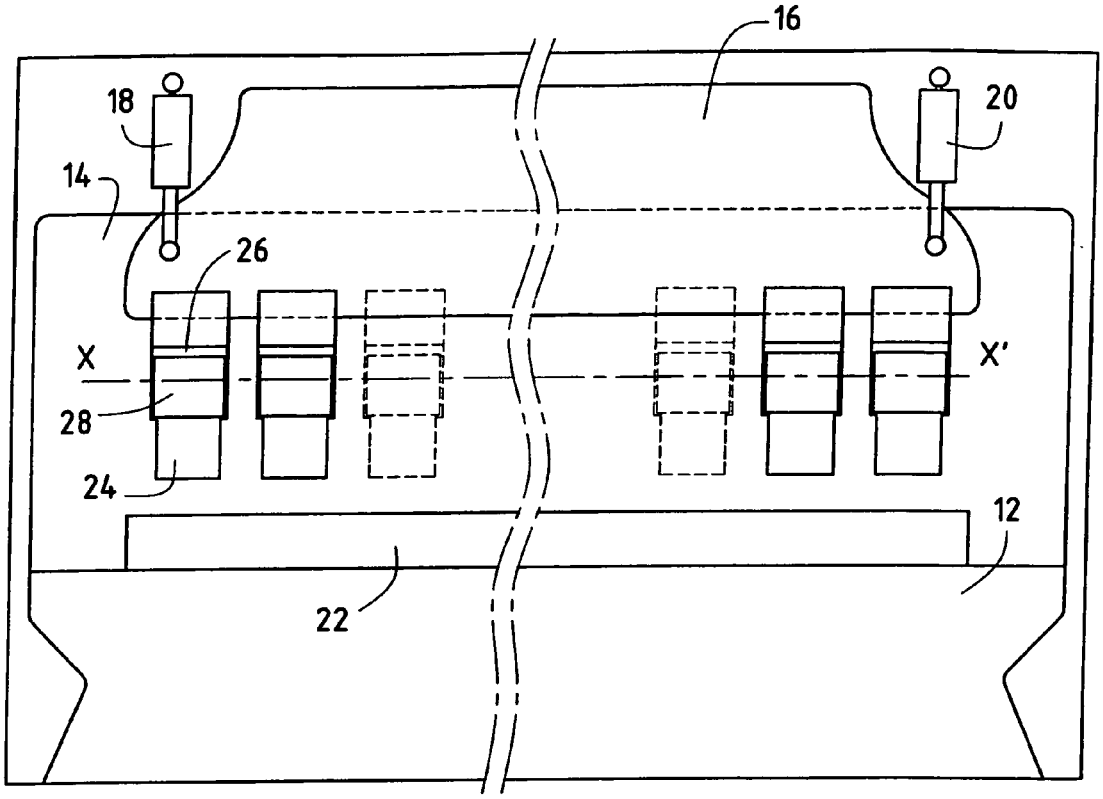
FIG. 1, described above, is a front view of a bending press as a whole.
Figure 3:
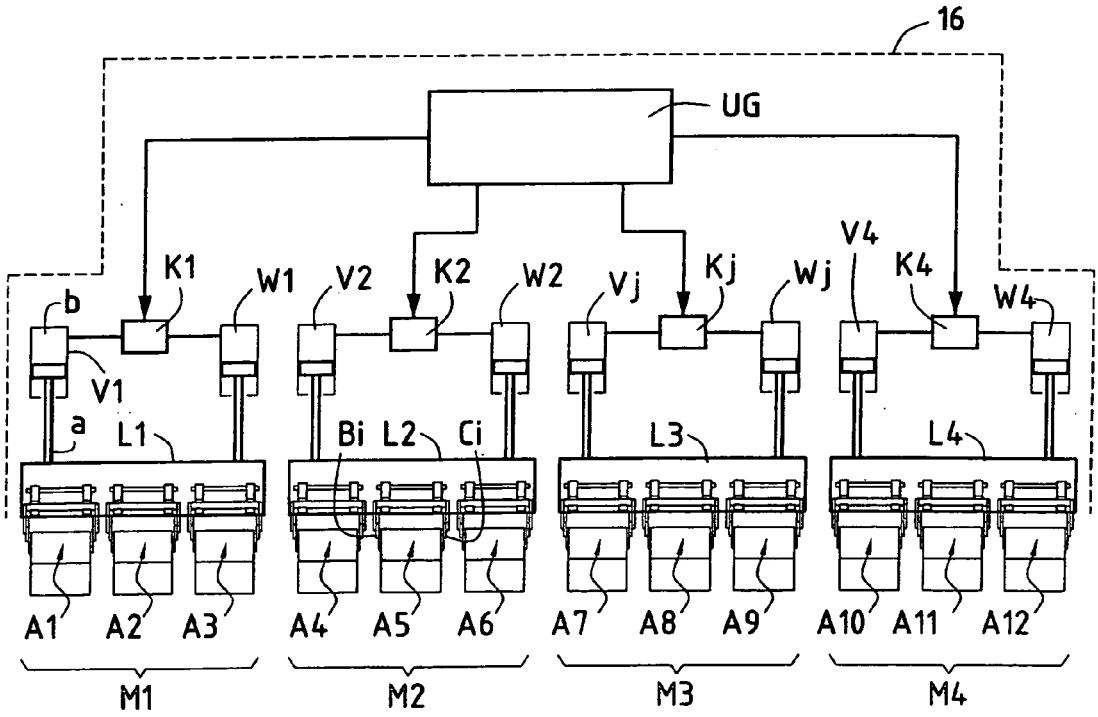
FIG. 3 is a simplified view of the top panel of a bending press in accordance with the invention.

FIG. 3 is a theoretical diagram showing the entire set of tools (punches) mounted on the top panel 16 in accordance with the invention. In this figure, the top panel is a moving panel while the bottom panel is a stationary panel. It would be equally possible for the top panel to be a stationary panel and for the bottom panel to be a moving panel. The various assemblies referenced $A_i$, each constituted by an intermediate piece 26 and its associated clamp 28, are grouped together in modules. In the particular example shown, the adjacent clamps are grouped together in threes, so as to obtain four modules M1, M2, M3, and M4 each constituted by three assemblies $A_i$ of a clamp and an intermediate piece. Naturally other configurations could be used, depending on the tools used and on the sequences of tools that are to be implemented.

This figure shows in simplified manner the mechanisms $B_i$, $C_i$ that are provided at the end of each intermediate piece 26 for causing the clamp to pivot relative to the intermediate piece. The mechanisms of the clamp and intermediate piece assemblies $A_i$ within a given module are interconnected by link means given a respective reference $L_1$, $L_2$, $L_3$, or $L_4$. Each link means L is associated with an actuator assembly which, in the particular embodiment described, is constituted by two actuators $V_i$, $W_i$ whose rods a are secured to the ends of a given link means $L_i$ and whose cylinders b are secured to the top panel 16. Preferably, the two actuators are disposed close to the ends of the link means $L_i$.

It will be understood that by causing the actuators V and W associated with a given module M to act simultaneously, simultaneous pivoting will be obtained of the clamps in the corresponding module.

Naturally, other actuators could be used. Nevertheless, hydraulic actuators are particularly suitable since hydraulic actuators are already used for causing the top panel of the press to move.

Each pair of actuators $V_i$, $W_i$ associated with a given module $M_i$ is controlled by a single hydraulic control circuit $K_i$. A central control unit UG enables the various hydraulic control circuits $K_i$ associated with the various modules to be controlled individually.

It will be understood that with such a control system, it is also possible simultaneously to control a plurality of modules, depending on which tools need to be changed.

Figure 4:
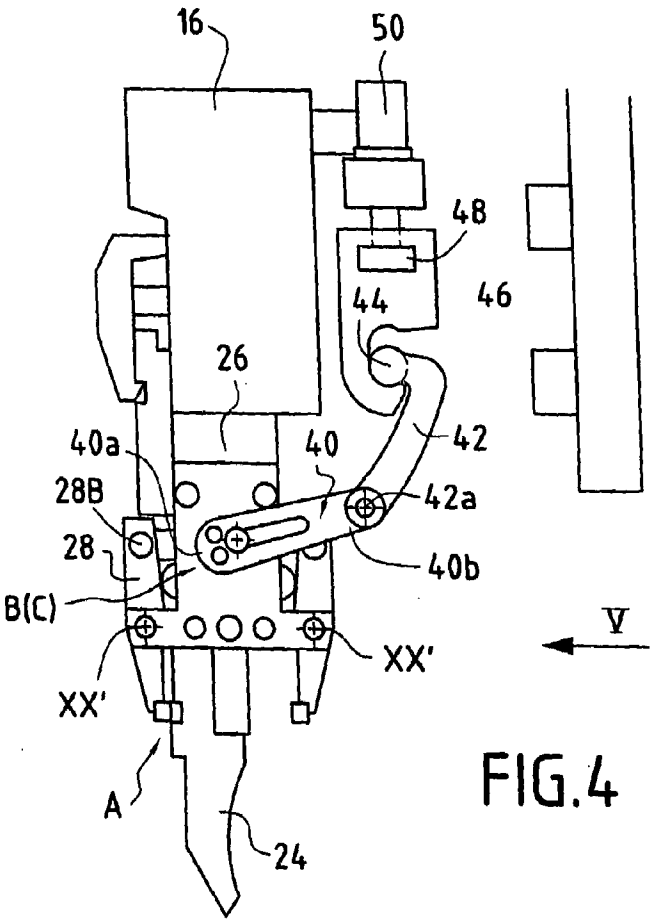
FIG. 4 is a side view of the top panel with its intermediate piece and its clamp fitted with pivot-control means in accordance with the invention.
Figure 5:
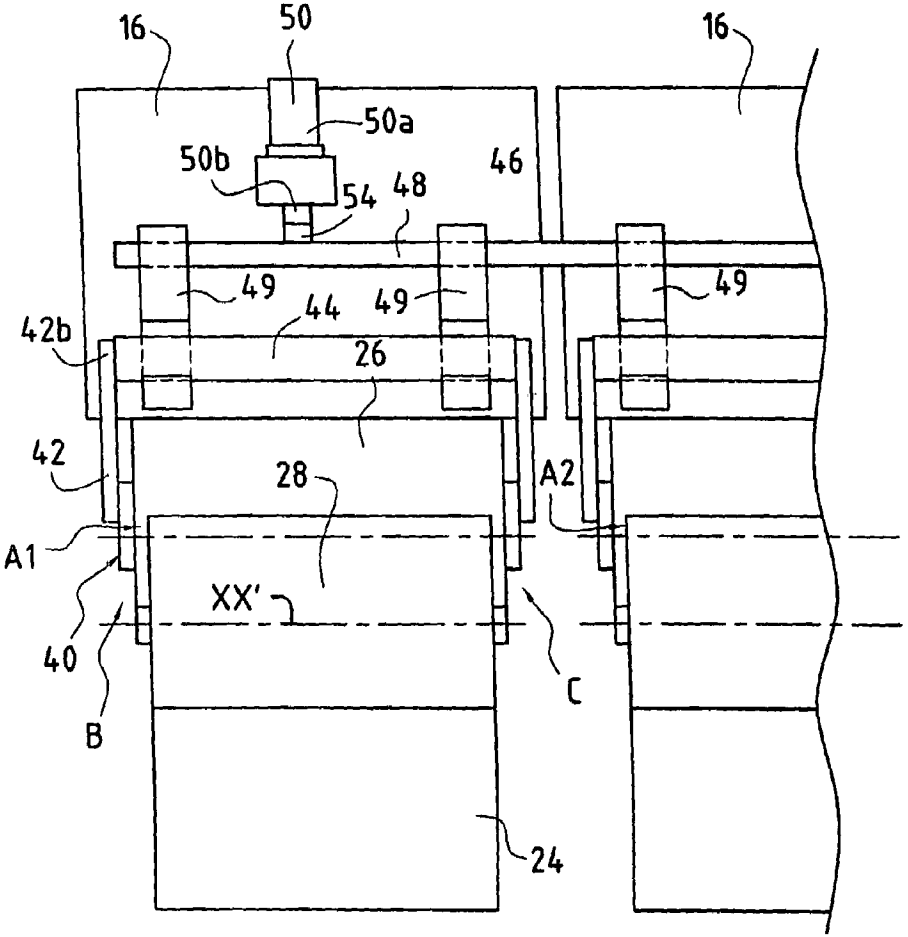
FIG. 5 is a fragmentary front view of clamps and intermediate pieces in accordance with the invention.

With reference more particularly to FIGS. 4 and 5, there follows a description of the linkage associated with each clamp assembly $A_i$ and with each module in a preferred embodiment of the invention.

FIG. 4 shows in simplified manner one of the end mechanisms B or C for causing the associated clamp 28 to pivot. This mechanism is described in greater detail below. At this stage in the description, it suffices to observe that the mechanism comprises a control member controlled by a lever 40. A first end 40*a* of the lever is connected to the mechanism proper, whereas the second end 40*b* of the lever is hinged to one end 42*a* of a second lever 42. The two ends 42*b* of the second levers associated with the same clamp 28 are preferably interconnected by a bar 44 so that both of the mechanisms associated with a single clamp operate synchronously. The bars 44 of the clamp assemblies $A_i$ belonging to a given module M are interconnected by a fork 46 constituting the link assembly L of FIG. 3. The fork 46 is constituted by a rod 48 extending parallel to the pivot axis of the clamp, and by hooks 49 that engage on the bars 44. Each fork 46 is associated with an actuator assembly which is preferably constituted by two actuators V and W as explained above. Only one actuator 50 is visible in FIG. 5. Each actuator comprises a cylinder 50*a* which is secured to the top panel 16 and an actuator rod 50*b* connected to the bar 48 via a fixing plate 54.

Figure 2A:
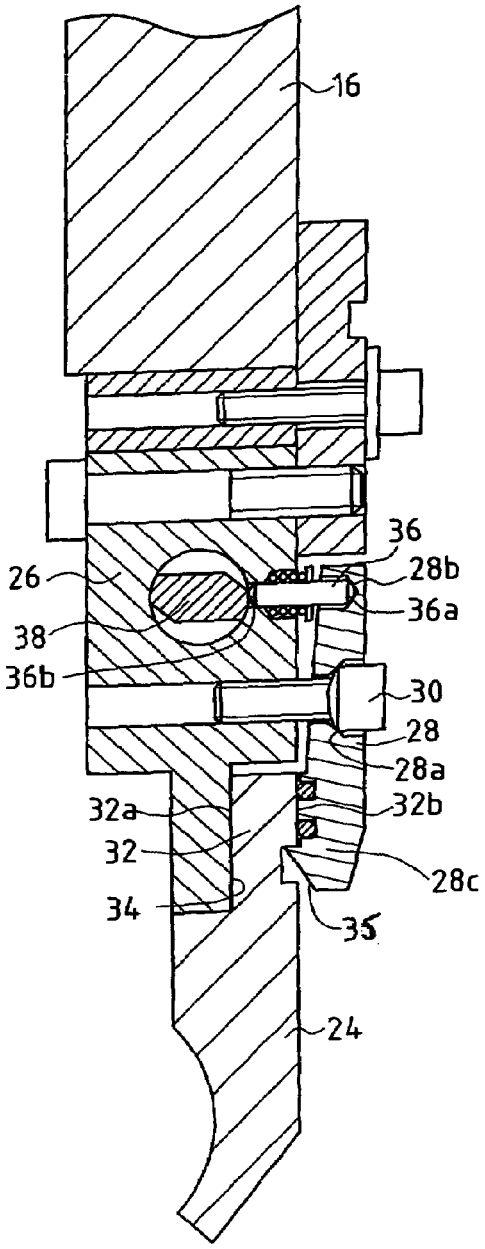
FIGS. 2A and 2B are cross-section views through the assembly comprising the intermediate piece and the clamp used for fixing the tool.
Figure 2B:
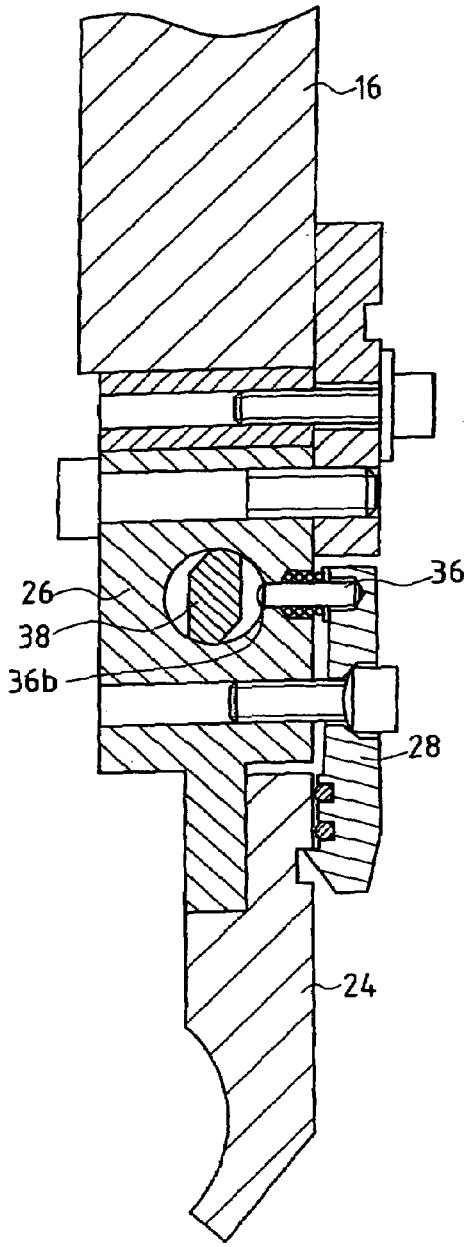

It will be understood that by simultaneously operating the actuators 50 associated with a given module M, the levers 40 are caused to move and thus also the pivot mechanisms B and C of the clamps 28 of the module between the clamping position shown in FIG. 2A and the disassembly position shown in FIG. 2B.

Figure 6A:
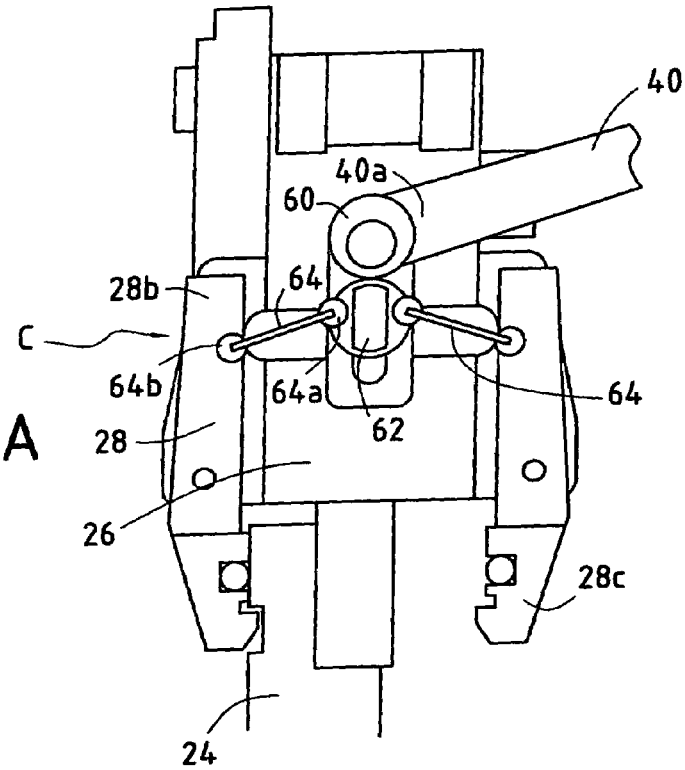
FIG. 6A is a side view of the top panel showing a first mechanism for pivoting the clamp.

With reference to FIG. 6A, there follows a description of a first embodiment of the mechanism B or C for controlling pivoting of the clamp.

The mechanism is constituted by an eccentric 60 fixed to the end 40*a* of the first lever 40. Pivoting of the eccentric 60 causes a follower 62 to move vertically, guided by a vertical slot 63 formed at the end of the intermediate piece 26. The follower 62 which moves in translation is secured to the first end 64*a* of each of two resilient arms 64, the second end 64*b* of each arm being secured to the control end 28*b* of the clamp, the two arms 64 being at an angle relative to the horizontal. When the lever 40 causes the eccentric 60 to pivot in a first direction, the eccentric causes the follower 62 to move downwards, thereby causing the ends 28*b* of the clamps to move away from the intermediate piece under drive from the arms 64. The first end 28*c* of the clamp is thus brought into the clamping position. In contrast, when the eccentric 60 is turned in the opposite direction, the follower 62 rises, tending to move the ends 28*b* of the clamps towards the intermediate piece, thereby bringing the ends 28*c* of the clamps towards their positions or removing the tool 24.

Figure 6B:
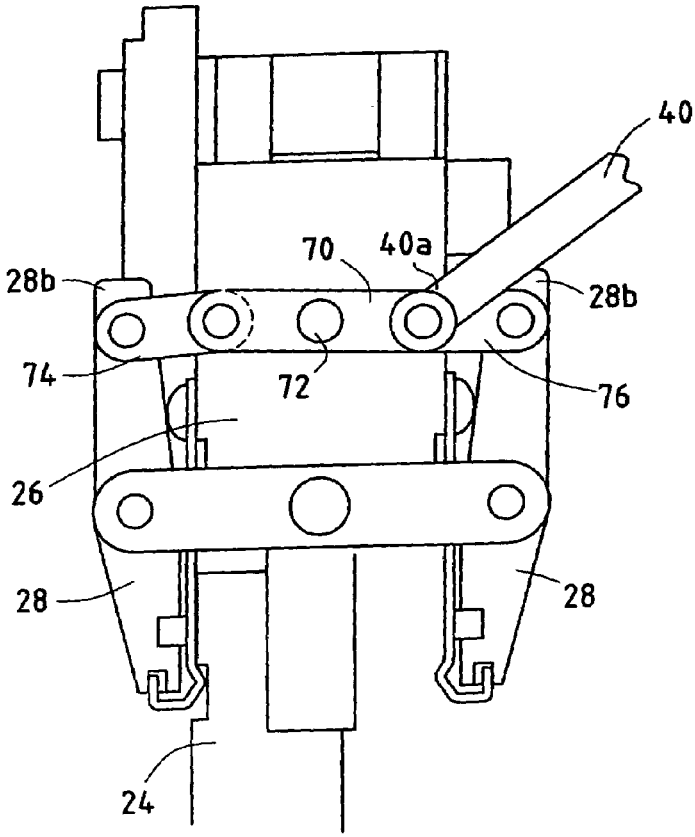
FIG. 6B is a view analogous to FIG. 6A, showing a second mechanism for pivoting clamps.

FIG. 6B shows a second example of the mechanisms B and C for pivoting the clamps 28. The mechanism is constituted by a toggle system that passes through an over-center point. It comprises a bar 70 that pivots relative to the intermediate piece 26 about a middle axis 72, and by two levers 74 and 76 hinged to respective ends of the bar 70 and to the control ends 28*b* of the clamps 28. The end 40*a* of the first control lever 40 is also hinged to one of the ends of the bar 70. Pivoting the lever 40 thus causes the bar 70 to pivot, and in turn causes the clamps 28 to pivot via the levers 74 and 76.

The modular nature of the bending press of the invention in terms of changing bending tools makes the machine particularly well adapted to implementing the so-called "step-bend" technique. This technique enables parts to be obtained of substantially cylindrical shape by making successive bends that are short and of angles that are wide open. Certain stages of the step-bend technique require a change of tool. Controlling the clamps in modules is then particularly advantageous since it enables the relevant tool to be changed without any need to loosen the adjacent tool. In other words, each module formed by clamps that are controlled simultaneously can be considered as constituting one of the bending stations needed for implementing the step-bend method.

What is claimed is:

1. A bending press comprising:

a bottom panel;

a top panel;

one of the panels being movable vertically relative to the other;

N bending-tool clamps, each clamp being mounted on one of said two panels to pivot about an axis common to all said bending tool clamps for clamping bending tools, said bending tool clamps forming a plurality of adjacent groups of adjacent clamps, the number of groups being less than N;

n actuator assemblies (1<n<N), each actuator assembly being adapted to take up one of two different states;

n transmission means for transmitting the state taken by each one of said n actuator assemblies to one of said groups of adjacent bending tool clamps in such a manner that each bending tool clamp is associated with a single actuator assembly; and means for separately controlling the state of each actuator assembly, said two states consisting of a first state, wherein the clamps associated with sad actuator assembly is brought to a position for clamping a bending tool, and a second state wherein the clamps associated with said actuator assembly is brought to a position for removing said bending tools.

2. A bending press comprising:

a bottom panel;

a top panel, said bottom panel is stationary and said top panel is vertically movable;

N intermediate members, each having two ends, each rigidly fixed to said top panel;

N bending-tool clamps, each of the clamps mounted on an intermediate member and pivoting about an axis common to all said clamps for clamping bending tools, said clamps forming a plurality of adjacent groups of adjacent clamps, the number of groups being less than N; and N clamp pivot mechanisms, each mechanism being associated with one clamp and one intermediate member, each mechanism presenting a control portion;

a plurality of link means for interconnecting the control portions of n mechanisms associated with n adjacent clamps, where n is an integer lying in the range 1<n<N;

n actuator assemblies (1<n<N), each actuator assembly being adapted to take up one of two different states;

n transmission means for mechanically connecting each actuator assembly to the link means, and for transmitting the state taken by each one of said n actuator assemblies to one of said groups of adjacent bending tool clamps in such a manner that each bending tool clamp is associated with a single actuator assembly; and means for separately controlling said state of each actuator assembly, said two states consisting of a first state, wherein the clamps associated with said actuator assembly is brought to a position for clamping a bending tool, and a second state wherein the clamps associated with said actuator assembly is brought to a position for removing said bending tools.

3. A bending press according to claim 2, wherein each clamp pivoting mechanism comprises two pivot assemblies mounted respectively at each end of the intermediate member associated with the clamp, each pivot assembly comprising a lever with a first end forming said control portion.

4. A bending press according to claim 3, wherein said lever being linked by link means comprises 2n bars with two ends, each bar being hinged at a first end to the first end of said lever, and means for interconnecting the second end of the bars.

5. A bending press according to claim 2, wherein each actuator assembly comprises at least one actuator whose cylinder is secured to the top panel and said transmission means is a rod whose end is connected to said link means.

6. A bending press according to claim 5, wherein each actuator means comprises two actuators, each actuator being connected by said rob to one end of said link means.

7. A bending press comprising:

a) two panels, a bottom panel and top panel, one of said two panels vertically movable relative to the other panel;

b) a plurality of bending-tool clamp assemblies, each of said assemblies having a bending-tool clamp, each of said assemblies mounted on one of said two panels and having a common axis about which each of said clamps pivots between two positions, a first position for clamping a bending tool and a second position for releasing said bending tool;

c) a plurality of actuator assemblies, each of said actuator assemblies associated with a group of two or more adjacent bending-tool clamp assemblies, each group of said bending-tool assemblies associate with one of said actuator assemblies, each of said actuator assemblies having two states, a first state corresponding said first position and a second state corresponding to said second position;

d) a plurality of transmission means for transmitting each of said two states of said actuator assemblies to said bending tool clamp assemblies, one of each of said transmission means associated with one of each of said actuator assemblies and with one group of adjacent bending-tool clamp assemblies associated with said one of said actuator assemblies; and e) a control means for separately controlling each of said actuator assemblies between said two states.

8. The press of claim 7, wherein, said bottom panel is stationary and said top panel moves;

said bending tool clamp assemblies comprises:

an intermediate member rigidly fixed to said top panel;

a clamp pivotably mounted to said intermediate member;

a pivot clamp mechanism connected to said clamp for pivoting said clamp between said first position and said second position; and a linking means for interconnecting each pivot clamp mechanism in said group of bending tool assemblies, each of said linking means connected to one of said transmission means.

9. The press of claim 8, wherein each pivot clamp mechanism comprises two pivot assemblies and each of said pivot assemblies is mounted on one side of intermediate member.

10. The press of claim 9, wherein, said pivot assemblies comprises levers connected between the linking means and the clamp.

11. The press of claim 8, wherein each of said actuator assemblies is at least one cylinder affixed to said top panel; and said transmission means is a rod connected from said cylinder to said linking means.

12. The press of claim 11 wherein, the linking means is a rod having two ends; and each actuator assemblies is two cylinders, each having a rod connected to opposite end of the same linking means.

* * * * *